United States Patent [19]

Merchant et al.

[11] Patent Number: 4,526,625

[45] Date of Patent: Jul. 2, 1985

[54] PROCESS FOR THE MANUFACTURE OF CONTINUOUS STRIP CAST ALUMINUM ALLOY SUITABLE FOR CAN MAKING

[75] Inventors: Harish D. Merchant, Fairfield, Conn.; James G. Morris, Lexington, Ky.; Gunther Scharf, Bonn, Fed. Rep. of Germany

[73] Assignee: Continental Can Company, Stamford, Conn.

[21] Appl. No.: 483,453

[22] Filed: Apr. 8, 1983

Related U.S. Application Data

[63] Continuation-in-part of Ser. No. 398,735, Jul. 15, 1982, abandoned.

[51] Int. Cl.[3] ..... C22F 1/04

[52] U.S. Cl. ..... 148/2; 148/11.5 A

[58] Field of Search ..... 148/2, 11.5 A, 12.7 A, 148/159, 415; 420/546

[56] References Cited

U.S. PATENT DOCUMENTS

| | | | |
|---|---|---|---|
| 3,318,738 | 5/1967 | Winter | 148/2 |
| 3,490,955 | 1/1970 | Winter et al. | 148/11.5 A |
| 3,930,895 | 1/1976 | Moser et al. | 148/11.5 A |
| 4,000,009 | 12/1976 | Chatfield | 148/2 |
| 4,111,721 | 9/1978 | Hitchler et al. | 148/11.5 A |
| 4,126,487 | 11/1978 | Morris et al. | 148/2 |
| 4,325,755 | 4/1982 | Blade et al. | 148/11.5 A |
| 4,334,935 | 6/1982 | Morris | 148/11.5 A |

*Primary Examiner*—L. Dewayne Rutledge
*Assistant Examiner*—Robert L. McDowell
*Attorney, Agent, or Firm*—Paul Shapiro

[57] ABSTRACT

Non-galling, low earing can stock suitable for deep drawing and wall-ironing into can bodies is prepared from continuously cast aluminum alloy strip of an inch or less in thickness. The strip material is heated to a temperature of from 950° to 1150° F. for a time sufficient to homogenize the alloy. The homogenized strip material is cold rolled to effect a first reduction in sheet thickness of at least 25%. The cold rolled sheet is heated to a recovery temperature of up to about 550° F., and subjected to a second cold rolling to effect a reduction in thickness of up to 50%. The cold rolled sheet product is heated to the recrystallization temperature and then subjected to effect a final reduction in thickness of at least 50% of the original thickness of the sheet to impart an H19 temper to the sheet.

11 Claims, No Drawings

PROCESS FOR THE MANUFACTURE OF CONTINUOUS STRIP CAST ALUMINUM ALLOY SUITABLE FOR CAN MAKING

This application is a continuation-in-part application of U.S. Ser. No. 398,735 filed July 15, 1982 and now abandoned.

BACKGROUND OF THE INVENTION

1. Field of the Invention

The present invention is directed to a process for preparing continuous strip cast aluminum alloy suitable for use in the manufacture of deep drawn and wall-ironed articles such as cans and the like.

2. The Prior Art

In recent years, aluminum alloys such as the Aluminum Association specification 3004 have been successfully fabricated into two piece beverage cans by deep drawing and ironing. The expanding use of two piece aluminum cans has created a need for aluminum alloy sheet for forming the can body that not only possesses the required combination of formability and strength properties but is also economical to manufacture.

Typically the aluminum alloy sheet useful in the production of deep drawn and ironed beverage cans is cast by direct chill casting an ingot having a thickness of about 20–25 inches. The ingot is homogenized at 950°–1125° F. for 4–24 hours and then subjected to hot rolling wherein the ingot is passed through a series of breakdown rolls maintained at a temperature of 400°–900° F. to reduce the ingot in thickness to a reroll gauge of about 0.130 inch.

Thereafter the reroll stock is subjected to an annealing step wherein the stock is heated at 600°–900° F. for 0.5–3 hours to effect recrystallization of the metal structure. The annealed reroll stock is subjected to a final work hardening step wherein the reroll stock is cold rolled (room temperature rolling) to a final gauge of about 0.013 inch or about 90% of its original thickness to produce the substantially full hard (H19) temper required for two-piece can body stock.

In spite of the successful use in can-making of direct chill ingot cast aluminum alloy, economic and energy considerations would favor the manufacture of the aluminum sheet by continuous strip casting. In this process the molten aluminum is cast and solidified into a thin web of one inch or less in thickness so that subsequent rolling is reduced and the costly step of hot rolling is eliminated.

In the manufacture of continuous strip cast aluminum alloy for can manufacture, the thin, e.g., 0.2–1.0 inch solidified cast web is typically reduced in thickness to a gauge of about 0.130 inch by cold rolling with an intermediate recrystallization anneal at about 600°–900° F. Thereafter, as in the manufacture of direct chill ingot cast stock, the thinned, annealed stock is subjected to a final work hardening step by cold rolling to a final gauge of about 0.013 inch to produce the H19 temper required for can body manufacture.

Although the continuous stip cast aluminum alloy is advantageously utilized for many fabricated products, such stock has not been used extensively for the manufacture of drawn and wall-ironed can bodies.

In the production of two-piece drawn and wall-ironed beverage cans, circular discs or blanks are cut or punched from the cold worked (H19) sheet for deep drawing into the desired shape. Deep drawing is a process for forming sheet metal between punch and die to produce a cup or shell-like part. When a deep drawn shell with a heavy bottom and thin sidewalls is desired, wall-ironing is used in conjunction with deep drawing. The blank is first drawn to approximately the final diameter cup. The sidewalls are then reduced in thickness in one or more ironing operations.

Because of the nature of the working stresses incurred during wall-ironing of the deep drawn shell, when continuous strip cast aluminum alloy such as 3004 is subjected to wall-ironing, scoring may occur on the die surface; alternately, deep grooves may appear on the finished can which is referred to in the art as "galling". Galling adversely affects the acceptability of the can product and the effectiveness of the can manufacturing process. Galling is not normally observed during wall-ironing aluminum sheets of the same alloy composition produced from direct chill cast ingot.

In spite of the economic advantage of the strip casting process, due to the drawback of not being gall-free when subjected to severe mechanical operations such as wall-ironing operations in two-piece aluminum can making, the utility and applicability of continuous strip cast aluminum alloy for can making has been extremely limited.

The art has addressed the problem of providing continuous strip cast aluminum alloys which have the capability to be gall-free when subjected to the severe mechanical working conditions of can making. For example, U.S. Pat. No. 4,111,721 discloses a process for imparting an anti-galling character to continuous strip cast aluminum alloy wherein the aluminum strip is heat treated at a temperature of at least 900° F. and advantageously at about 1150° F. for a period of time between about 16 to 24 hours prior to its final cold reduction pass.

The art prior to U.S. Pat. No. 4,111,721, namely U.S. Pat. No. 3,930,895 disclosed that in the process of making continuous strip cast aluminum alloy suitable for can making, the cast strip, before cold rolling, is homogenized at a temperature of about 950° to 1050° F. for about 8 to about 16 hours.

Although the art reported that gall-free continuous strip cast aluminum alloy had been produced, the strip has remained substantially unacceptable for can making stock because of the problem of "earing" which manifests itself as a scalloped appearance around the top edge of the cup during the deep drawing cup formation step of the draw and wall-iron processing of the aluminum sheet.

The scallops, or ears, represent an almost universally undesirable feature of the cup as the ears must be removed in order to present a smooth or flat upper lip on the cup. This of course necessitates cup trimming prior or subsequent to wall-ironing, with an attendant increase in production costs and material waste.

The level of earing in a drawn cup is determined by the following equation:

$$\frac{he - ht}{(he + ht)/2} \times 100 = \% \text{ Earing}$$

where he is the distance between the bottom of the cup and the peak of the ear and ht is the distance between the bottom of the cup and the valley of the ear.

To be acceptable for can making, the aluminum alloy sheet when processed into a cup must exhibit a level of earing of no more than about 3.5% and preferably less than about 3% earing. The level of earing experienced with commercially available continuously cast strip of 3004 aluminum alloy is generally in the range of 5% or more.

It is evident, therefore, that the reduction of the degree of earing during deep drawing of continuous cast aluminum strip to a level of about 3.5% or less represents a major contribution to the art of manufacture of continuous cast aluminum strip can stock.

STATEMENT OF THE INVENTION

The present invention is directed to a process for the preparation of non-galling, low earing can stock from continuously cast aluminum strip suitable for deep drawing and wall-ironing into hollow articles wherein the molten aluminum material is cast by continuous strip casting into a web generally of an inch or less in thickness. The strip material is heated to a temperature of from 950° to 1150° F. for a time sufficient to homogenize the alloy. The homogenized strip material is cold rolled to effect a first reduction in sheet thickness of at least 25%. The cold rolled sheet is heated to a recovery temperature of up to about 550° F., and subjected to a second cold rolling to effect a reduction in thickness of at least 10%. The cold rolled sheet product is heated to effect recrystallization of the grain structure and then subjected to effect a final reduction in thickness of at least 50% of the original thickness of the sheet to impart an H19 temper to the sheet.

To effect the most advantageous reduction in earing, the sheet is subjected to a second recovery heating of up to 550° F. intermediate between the second cold reduction and the recrystallization heating step.

As will hereinafter be illustrated, it has been determined that in the fabrication of strip cast aluminum sheet suitable for the production of drawn and wall-ironed beverage containers, control of the homogenization step within the parameters set forth above will render the sheet resistant to galling when subjected to drawing and ironing operations. Control of the cold roll and recovery heating parameters set forth above prior to the recrystallization heating step, will result in the fabrication of an aluminum sheet exhibiting low earing properties as well as non-galling characteristics.

PREFERRED EMBODIMENTS

Generally in affecting homogenization to prepare an aluminum alloy sheet product in accordance with the present invention, the continuous cast web is heated at about 950° to about 1150° F. and preferably about 1000° to about 1100° F. for a period of time up to about 50 hours and preferably about 10 to about 25 hours. Advantageously, the homogenization treatment is conducted at a temperature of about 1100° F. for at least about 10 hours. It is recovnized that sevewral hours are required to heat the metal to reach the temperature at which homogenization is effected.

In the event that the cast aluminum web is subjected to homogenization temperatures while in coil form, it has been determined that the coil be heated in a slow, pre-programmed manner for time periods ranging from 2 to 10 hours at increasing temperatures to avoid incipient melting of the alloy which will otherwise cause the coil layers to fuse and weld together and render the coiled product unsuitable for subsequent use. A programmed heating sequence which has been found advantageous for the homogenization of the continuous cast aluminum coil is as follows:

Temperature of the web is raised from ambient (75° F.) to 1000° F. over a 5 hour period.

Temperature of the web is raised from 1000° to 1050° F. over a 3 hour period.

Temperature of the web is raised from 1050° to 1100° F. over a 5 hour period.

Web is homogenized at 1100±10° F. for 20 hours.

The homogenization step of the process of the present invention imparts a very critical change in the microstructure of the alloy primarily in the size, shape and distribution of the intermetallic particles present in the alloy matrix. It has been determined that the change in intermetallic particle disposition is dependent upon the temperature as well as the time of the homogenization treatment and that the degree of galling is inversely dependent upon the intermetallic particle size, shape, distribution and volume fraction.

Examination of photomicrographs of 3004 aluminum alloy subjected to the homogenization sequence of the present invention indicates that the secondary constituents in the aluminum alloy, e.g. (MnFeSi)Al, are caused to agglomerate whereby they change their shape substantially and increase in size. The net effect of this is the development of intermetallic particles approaching a globular shape having a particle size of 1 to 3 microns. These relatively large, globular shaped particles are believed to act as galling-resistant bearings for the strip cast stock during the severe mechanical working encountered in the wall-ironing operations of two piece can manufacture.

For example, continuous cast 3004 aluminum alloy strip cold rolled and size-reduced to 0.0135 inch gauge to H-19 temper by conventional practice typically has an intermetallic particle size in the order of 0.3–0.7 microns. As already indicated, this strip when subjected to ironing operations encounters severe galling. However, if the aluminum web is subjected to the homogenization step, as previously described, prior to cold rolling, the intermetallic particle size increases with increasing homogenization temperature which results in a proportionate decrease in galling when the homogenized strip is subjected to wall-ironing conditions.

The relationship between homogenization temperature, intermetallic particle size and galling is summarized in the Table below:

TABLE

| Homogenization Temperature (°F.)* | Intermetallic Size (Microns) | Galling |
|---|---|---|
| 900–950 | 0.5–1.0 | Moderate |
| 1000–1050 | 0.7–1.2 | Marginal |
| 1090–1140 | 1.0–3.0 | None |

*20 hours @ temperature

Although the aluminum web when homogenized at 950°–1150° F. will encounter no galling during wall-ironing a cup formed from the web, it will after being subjected to drawing operations, exhibit unacceptably high earing.

By following the cold roll/recovery-recrystallization heating sequence of the present invention there is attained a reduction in earing to levels required for commercial acceptance of the drawn and wall-ironed container.

Thus, after the aluminum alloy stock has been produced by continuous strip casting and homogenized in accordance with the parameters disclosed above, the cooled web which has a thickness of up to one inch and typically about 0.25 to about 0.50 inch in thickness is subjected to a first cold rolling step to effect a total gauge reduction in excess of about 25% and preferably about 50 to about 85%. Thereafter the cold rolled sheet is heated to a recovery temperature level.

The term "recovery temperature" as it is used in the art means the temperature at which the rolled metal is heated whereby it is softened without forming a new grain structure. For aluminum alloys of the 3004 type the recovery temperature is in the range of about 200° to about 550° F. The recovery temperature to which the cold rolled web may be heated after the first cold roll reduction is about 350° to about 500° F. for about 2 to about 6 hours and preferably from about 425° to about 475° F. for 2 to 4 hours.

After being heated at the recovery temperature the heated web is cooled to ambient temperature and subjected to a second cold rolling step to effect a total reduction in thickness of the web of at least 10% and preferably between about 10 to about 50%.

As will hereinafter be illustrated, heating the web to a recovery temperature intermediate between the two cold rolling steps is critical to imparting a low earing characteristic to the aluminum sheet.

After the second cold roll step, the temperature of the cold rolled web is raised to the "recrystallization temperature" level.

The term "recrystallization temperature", as it is used in the art, means the temperature at which the rolled metal web softens simultaneously with the formation of a completely new grain structure. In the case of 3004 alloy, the grain structure changes from a substantially elongated structure to an equiaxed structure when the alloy is heated at the recrystallization temperature.

In the practice of the present invention the recrystallization temperature is in the range of about 600° to about 900° F., the heating being effected for about 1 to about 4 hours and preferably at a temperature between about 700° to about 850° F. for about 2 to about 3 hours.

After heating at the recrystallization temperature for the prescribed time period, the recrystallized web is cooled to ambient temperature and then cold rolled, e.g., to at least about 50% and preferably about 60 to about 90%, to the final gauge dictated by can performance requirements, e.g., 0.012 to 0.0145 inch.

To achieve an optimum reduction in earing the aluminum web is heated a second time to a recovery temperature, the second recovery heating occurring between the second cold rolling step and the recrystallization heating step. The second recovery heating is effected at a temperature between about 450° and 550° F. for about 0.5 to about 3 hours and preferably between about 475° to about 525° F. for about 0.75 to about 1.25 hours.

In effecting the second recovery heating, the web may be cooled to room temperature bewtween the second recovery heating step and the recrystallization step. Preferably the recrystallization heating is carried out without prior cooling to room temperature by direct heating from the second recovery temperature to the recrystallization temperature.

It has been further determined that to achieve a consistency in earing reduction results it is advantageous that, after the homogenization step of the process of the present invention the web is cooled in a controlled stepped manner, i.e., at a cooling rate of no more than 75° F./hr. A preferred sequence of cooling is summarized as follows:

| Temperature Range of Cooling, °F. | Time to Reach Lower Temperature (Hours) | Average Cooling Rate °F./hr |
|---|---|---|
| 1100–900 | 4.0 | 50 |
| 900–750 | 2.0 | 75 |
| 750–375 | 12.5 | 30 |

A more thorough understanding of the present invention may be attained by reference to the following specific examples of the practice of the invention.

EXAMPLE I

A series of strip-cast aluminum alloys having varying alloy constituents including those within the Aluminum Association Specification 3004 aluminum alloy range were evaluated for use in the fabrication of drawn and wall-ironed can bodies. The composition of the alloys is summarized in Table I below:

TABLE I

| | Compostion of Alloys (Wt. %) | | | | | |
|---|---|---|---|---|---|---|
| | Mg | Mn | Fe | Si | Zn | Cr |
| Alloy I | 1.07 | 0.94 | 0.32 | 0.22 | 0.06 | — |
| Alloy II | 1.14 | 1.12 | 0.23 | 0.28 | 0.02 | 0.11 |
| Alloy III | 1.10 | 1.08 | 0.22 | 0.30 | 0.02 | — |
| Alloy IV | 1.03 | 1.00 | 0.41 | 0.21 | 0.05 | — |

One foot wide by three feet long sections of the cast aluminum strip having a thickness of 0.48 inch were placed in a furnace in a nitrogen atmosphere, brought up rapidly to the desired temperature, and held for 10 to 40 hours at homogenization temperatures varying from 1094° to 1130° F. Thereafter the strips were removed from the furnace and cooled to ambient temperature by blowing cold compressed air on the strips. The homogenization conditions used in the series of runs are summarized in Table II as follows:

TABLE II

| HOMOGENIZATION CONDITIONS | | |
|---|---|---|
| HOMOGENIZATION CONDITION | TEMP (°F.) | TIME AT TEMP (HRS) |
| A | 1130 | 30 |
| B | 1112 | 35 |
| C | 1094 | 40 |
| D | 1100 | 10 |

The cooled strips were rolled in successive passes using a commercial rolling mill until the strip was reduced to varying degrees of thickness ranging from 66 to 75% (0.160 to 0.120 inch).

The reduced thickness strips were subjected to a first recovery temperature wherein the strips were placed in a furnace previously heated to 450° F. and held for 3 hours after which time the strips were removed from the furnace and allowed to cool to room temperature.

After being subjected to the first cold roll/recovery temperature treatment, the strips were subjected to a second cold roll reduction by being passed successively through a pair of reduction rolls until the strip was reduced 10–25% in thickness (to 0.120 inch).

After the second cold roll reduction the strips were subjected to a second recovery heating at 500° F. for one hour and then annealed at a recrystallization temperature of 800° F. for 2 hours.

The cold roll/recovery-recrystallization (anneal) conditions to which the series of strips were subjected are summarized in Table III below.

For purposes of contrast, the cold roll/anneal conditions of Example I were repeated with the exception that no recovery temperature heating was effected between the cold roll reduction step and the recrystallization step. These contrasting conditions are summarized in Table III below designated by the symbols "$C_1$" and "$C_2$".

TABLE III

| COLD ROLL/ ANNEAL CYCLE No. (°F.) | 1st COLD REDUCTION (% Red.) | 1st RECOVERY HEATING Temp (°F.) | 1st RECOVERY HEATING Time @ Temp (Hrs) | 1st RECRYST. HEATING Temp (°F.) | 1st RECRYST. HEATING Time @ Temp (Hrs) | 2nd COLD REDUCTION (% Red.) | 2nd RECOVERY HEATING Temp (°F.) | 2nd RECOVERY HEATING Time @ Temp (Hrs) | 2nd RECRYST HEATING Temp | 2nd RECRYST HEATING Time |
|---|---|---|---|---|---|---|---|---|---|---|
| 1 | 72 | 450 | 3 | None | | 10 | 500 | 1 | 800 | 2 |
| 2 | 66 | 450 | 3 | None | | 25 | 500 | 1 | 800 | 2 |
| $C_1$ | 75 | None | | 800 | 3 | None | None | | None | |
| $C_2$ | 50 | None | | 900 | 2 | 40 | None | | 800 | 2 |

The recrystallized strips were cooled to ambient temperature and then work hardened by passing the strips successively in a commercial rolling mill until the strip was reduced about 88% in thickness (H19 temper) to 0.0134 to 0.0148 inch.

The H19 temper strips were examined under a scanning electron microscope in the back scattering mode and found to have an intermetallic particle size in the 1 to 3 microns range indicating that no galling would occur when the strips were subjected to the wall-ironing conditions of can making.

To determine the extent of earing which would occur when the strips were subjected to the drawing operations of can making, circular blanks 2.20 inch diameter were cut from the H19 hardened strips and deep drawn into shallow cups of 1.32 inch diameter with a resultant 39% reduction in diameter. The tooling used for deep drawing 0.0135 inch sheet was designed to yield about a 3.5% positive clearance (0.0005 inch) between the walls of the punch and die. A die clearance of 5% or less and a reduction in diameter of 39% is typically required in this standard test for canstock earing which simulates the drawing step of the can making process. Cupping speed and blank clamping pressure were adjusted for each test to obtain a fracture and wrinkle-free cup.

The results of the earing tests using strips of the alloy compositions of Table I which had been subjected to the homogenization and cold roll/anneal conditions disclosed in Tables II and III are summarized in Tables IV and B below. Each earing test result represents an average of three tests.

The results of earing tests on aluminum strips subjected to comparative cold roll/anneal cycles $C_1$ and $C_2$ are summarized in Table VI below.

TABLE IV

EARING TEST RESULTS
COLD ROLL/ANNEAL CYCLE 1

| ALLOY TYPE | HOMOGENIZATION CONDITION | FINAL SHEET GAUGE (INCH) | EARING % |
|---|---|---|---|
| I | A | 0.0140 | 3.20 |
| II | A | 0.0148 | 2.96 |
| III | A | 0.0142 | 3.72 |

TABLE IV-continued

EARING TEST RESULTS
COLD ROLL/ANNEAL CYCLE 1

| ALLOY TYPE | HOMOGENIZATION CONDITION | FINAL SHEET GAUGE (INCH) | EARING % |
|---|---|---|---|
| I | B | 0.0139 | 3.54 |
| II | B | 0.0142 | 3.82 |
| III | B | 0.0146 | 3.58 |
| IV | B | 0.0142 | 3.03 |
| I | C | 0.0139 | 3.98 |
| II | C | 0.0145 | 3.61 |
| III | C | 0.0141 | 3.70 |
| IV | C | 0.0143 | 2.71 |
| I | D | 0.0142 | 3.14 |
| II | D | 0.0142 | 3.13 |
| III | D | 0.0141 | 3.06 |

TABLE V

EARING RESULTS
COLD ROLL/ANNEAL CYCLE 2

| ALLOY TYPE | HOMOGENIZATION CONDITION | FINAL SHEET GAUGE (INCH) | EARING % |
|---|---|---|---|
| I | B | 0.0145 | 3.51 |
| II | B | 0.0143 | 3.43 |
| III | B | 0.0146 | 3.58 |
| I | C | 0.0141 | 4.39 |
| II | C | 0.0140 | 4.08 |
| III | C | 0.0143 | 4.04 |
| I | D | 0.0140 | 3.59 |
| II | D | 0.0143 | 3.36 |
| III | D | 0.0140 | 3.54 |

TABLE VI

EARING RESULTS
COLD ROLL/ANNEAL CYCLES $C_1$ and $C_2$

| COLD ROLL ANNEAL CYCLE | ALLOY TYPE | HOMO-GENIZATION CONDITION | FINAL SHEET GAUGE (INCH) | EARING % |
|---|---|---|---|---|
| $C_1$ | IV | A | 0.0141 | 6.3 |
| $C_1$ | IV | B | 0.0138 | 5.9 |
| $C_2$ | IV | A | 0.0139 | 6.1 |
| $C_2$ | IV | B | 0.0143 | 5.2 |
| $C_2$ | IV | C | 0.0144 | 6.6 |
| $C_2$ | IV | D | 0.0142 | 5.7 |

By reference to the earing data summarized in Tables IV and V, and comparing such data to the comparative earing data in Table VI, it is readily apparent that aluminum strip treated in accordance with cold roll/anneal cycles 1 and 2 produce lower earing when compared to comparative cold roll/anneal cycles $C_1$ and $C_2$. The data indicates that cold roll/anneal cycles 1 and 2 which involve one or more recovery heating steps prior to recrystallization heating are more effective in reducing earing than anneal cycles $C_1$ and $C_2$ in which there are one or more recrystallization heating steps but no recovery heating step. Cold roll/anneal cycle 1 produces superior earing results when compared to cold roll/anneal cycle 2; cycle 1 having a lower second rolling reduction (10%) than cycle 2 (25%), indicating that a low (10%) second rolling reduction is desirable in reducing earing.

EXAMPLE II

The procedure of Example I was repeated with the exception that there was simulated the heating and cooling conditions that would be expected to occur in a commercially produced 10–15 ton coil of continuous strip cast aluminum alloy 3004 of about 0.50 inch thickness which had been subjected to the heating sequence of the present invention.

The programmed heating and cooling sequences outlined in the preferred embodiments section of this application (pages 6 and 10) were used to achieve strip homogenization in these coil simulation tests. The time and temperature used in the heating and cooling sequences are summarized in Table VII below:

TABLE VII

| HOMOGENIZATION CONDITIONS | | | | |
|---|---|---|---|---|
| HOMOGENIZATION CONDITION | TEMP (°F.) | TIME TO REACH TEMPERATURE (HOURS) | TIME AT TEMP (HOURS) | COOLING TIME TO 375°F. (HOURS) |
| E | 1112 | 13 | 35 | 35 |
| F | 1094 | 13 | 40 | 40 |
| G | 1094 | 10 | 10 | 20 |

The strips homogenized in accordance with Table VII were then cooled in accordance with the following schedule:

| Temperature Drop (°F.) | Time to Reach Lower Temperature (Hours) |
|---|---|
| 1130 to 1100 | 0.6 |
| 1100 to 900 | 4.0 |
| 900 to 750 | 2.0 |
| 750 to 375 | 12.5 |

At 375° F. the furnace was shut off and the strips allowed to cool to room temperature.

The cooled strips were then cold rolled/annealed in the manner of Example I using the cold roll/anneal conditions summarized in Table VIII below.

For purposes of contrast, the cold roll/anneal conditions of Example II were repeated with the exception that no recovery temperature heating was effected between the cold roll reduction step and the recrystallization step. This contrasting condition is summarized in Table VIII below designated by the symbol $C_3$.

TABLE VIII

| COLD ROLL/ ANNEAL CYCLE Type | 1st COLD REDUCTION (% Red.) | 1st RECOVERY HEATING Temp (°F.) | 1st RECOVERY HEATING Time @ Temp (Hrs) | 1st RECRYST. HEATING Temp (°F.) | 1st RECRYST. HEATING Time@ Temp (Hrs) | 2nd COLD REDUCTION (% Red.) | 2nd RECOVERY HEATING Temp (°F.) | 2nd RECOVERY HEATING Time @ Temp (Hrs) | 2nd RECRYST HEATING Temp (°F.) | 2nd RECRYST HEATING Time (Hrs) |
|---|---|---|---|---|---|---|---|---|---|---|
| 5 | 72 | 450 | 3 | None | | 10 | 500 | 1 | 800 | 2 |
| 6 | 66 | 450 | 3 | None | | 25 | 500 | 1 | 800 | 2 |
| 7 | 75 | 400 | 4 | 800 | 2 | None | None | | None | |
| 8 | 66 | 500 | 1 | 800 | 2 | 25 | 500 | 1 | 800 | 2 |
| $C_3$ | 75 | None | | 800 | 3 | None | None | | None | |

The heating and cooling conditions that would be expected to occur in processing a commercial coil were used in each recovery and recrystallization step. These conditions are summarized in Table IX below:

TABLE IX

| COIL SIMULATION HEATING/COOLING CONDITIONS | | | | | | | |
|---|---|---|---|---|---|---|---|
| COLD ROLL/ ANNEAL CYCLE | TIME TO REACH 1st RECOVERY TEMP. (HRS) | TIME TO COOL TO 75° F. (HRS) | TIME TO REACH 1st RECRYST. TEMP. (HRS) | TIME TO COOL TO 375° F. (HRS) | TIME TO REACH 2nd RECOVERY TEMP. (HRS) | TIME TO REACH 2nd RECRYST. TEMP. (HRS) | TIME TO COOL TO 375° F. (HRS) |
| 5 | 4 | 6 | — | — | 5 | 4 | 11 |
| 6 | 4 | 6 | — | — | 5 | 4 | 11 |
| 7 | 5 | — | 4 | 10 | — | — | — |
| 8 | 5 | — | 4 | 5 | 5 | 4 | 11 |
| $C_3$ | — | — | 7 | 10 | — | — | — |

The cooled recrystallized strips of Table IX were work hardened to H19 temper and reduced in thickness to 0.0134 to 0.0148 inch.

The H19 temper strips were examined under a scanning electron microscope in the back scattering mode and found to have an intermetallic particle size in the 1 to 3 microns range, indicating that no galling would occur when the strips were subjected to the wall-ironing conditions of can making.

The results of earing tests using strips of the alloy compositions of Table I which had been subjected to the homogenization and cold roll/anneal conditions as disclosed in Tables VIII and IX are summarized in Tables X–XII below. Each earing test result represents an average of 3 tests.

The results of earing tests on aluminum strips subjected to comparative cold roll/anneal cycle $C_3$ are summarized in Table XIV below.

TABLE X

| EARING RESULTS COLD ROLL/ANNEAL CYCLE 5 | | | |
|---|---|---|---|
| ALLOY TYPE | HOMOGENIZATION CONDITION | FINAL GAUGE (INCHES) | EARING % |
| I | G | 0.0138 | 3.12 |
| II | G | 0.0143 | 3.12 |
| III | G | 0.0140 | 2.67 |

TABLE XI

| EARING RESULTS COLD ROLL/ANNEAL CYCLE 6 | | | |
|---|---|---|---|
| ALLOY TYPE | HOMOGENIZATION CONDITION | FINAL GAUGE (INCHES) | EARING % |
| I | F | 0.0133 | 4.81 |
| II | F | 0.0139 | 4.33 |
| III | F | 0.0138 | 4.65 |
| I | G | 0.0140 | 4.28 |
| II | G | 0.0142 | 3.36 |
| III | G | 0.0141 | 4.24 |

TABLE XII

| EARING RESULTS COLD ROLL/ANNEAL CYCLE 7 | | | |
|---|---|---|---|
| ALLOY TYPE | HOMOGENIZATION CONDITION | FINAL GAUGE (INCHES) | EARING % |
| I | F | 0.0140 | 4.36 |
| II | F | 0.0139 | 4.20 |
| III | F | 0.0128 | 5.74 |
| I | G | 0.0136 | 4.28 |
| II | G | 0.0138 | 3.76 |
| III | G | 0.0139 | 4.14 |

TABLE XIII

| EARING RESULTS COLD ROLL/ANNEAL CYCLE 8 | | | |
|---|---|---|---|
| ALLOY TYPE | HOMOGENIZATION CONDITION | FINAL GAUGE (INCHES) | EARING % |
| I | E | 0.0139 | 3.98 |
| II | E | 0.0139 | 3.98 |
| III | E | 0.0140 | 4.40 |

TABLE XIV

| EARING RESULTS COLD ROLL/ANNEAL CYCLE $C_3$ | | | |
|---|---|---|---|
| ALLOY TYPE | HOMOGENIZATION CONDITION | FINAL GAUGE (INCHES) | EARING % |
| I | F | 0.0131 | 4.66 |
| II | F | 0.0136 | 3.77 |
| III | F | 0.0133 | 5.99 |
| I | G | 0.0137 | 3.83 |
| II | G | 0.0139 | 4.59 |
| III | G | 0.0134 | 4.87 |

By reference to the data summarized in Tables X–X-III and comparing such data to that in Table XIV, it is readily apparant that the largest reduction in earing occurs when cold roll/anneal cycle 5, which employs two recovery heatings prior to recrystallization, is used.

Cold roll/anneal cycle 6 which is identical to cycle 5, except that a second cold roll reduction of 25% is used instead of 10%, produces a reduction in earing but the reduction achieved is less than that achieved using cycle 5, indicating that a second cold roll reduction of 10% is more advantageous in effecting a reduction in earing.

Cold roll/anneal cycle 7 which utilizes a single recovery heating/single recrystallization heating sequence does not achieve the earing reduction level of cycle 5 but does produce a superior reduction in earing when compared to the single recrystallization heating of cold roll/anneal cycle $C_3$.

The double recovery heating/recrystallization heating of cycle 8 produces a reduction in earing when compared to control cycle $C_3$, but does not provide an advantage over cycle 5 which utilizes only one recrystallization heating.

EXAMPLE III

A second series of strip cast aluminum alloys were evaluated for use in the fabrication of drawn and wall ironed can bodies. The composition of the alloys is summarized in Table XV below:

TABLE XV

| | Composition of Alloys (wt. %) | | | | | | |
|---|---|---|---|---|---|---|---|
| | Mg | Mn | Fe | Si | Zn | Cr | Cu |
| Alloy A | 1.13 | 1.15 | 0.46 | 0.17 | 0.07 | 0.26 | 0.15 |
| Alloy B | 0.90 | 0.96 | 0.35 | 0.13 | 0.06 | 0.25 | 0.15 |
| Alloy C | 1.05 | 1.03 | 0.49 | 0.19 | 0.07 | 0.20 | 0.15 |

Copper was incorporated in the alloys to simulate recycling aluminum can scrap which invariably contains 0.1 to 0.2 percent by weight copper.

The aluminum alloys were continuously cast, using a twin roll caster, into 0.26 inches thick and 30 inches wide strip which was wound into about 5000 pound coils. The coils were allowed to reach room temperature over a 48 hour period. The cooled coils were then placed in a furnace and homogenized in a nitrogen atmosphere. The coil was brought up to 1076° F.±7° F. over a 12 hour period and held at that temperature for 16 hours. Thereafter the coils were allowed to cool in the furnace to 200° F. over a 32 hour period. The cooled coils were removed from the furnace and further allowed to cool to room temperature over the next 48 hours.

The room temperature cooled coils were subjected to a first cold roll/recovery temperature treatment wherein the cooled coils were rolled in successive passes using commercial rolling equipment until each of the coils was reduced between 83 and 85%, to varying degrees of thickness from 0.052 to 0.059".

The reduced thickness coils were subjected to a first recovery temperature wherein the coils were placed in a furnace and heated to 450° F.±3° F. over a 4 hour period and held at this temperature for 4 hours whereupon the coils were allowed to cool in the furnace to 300° F. over a period of nine hours. The coils were removed from the furnace and allowed to cool to room temperature over the next 48 hours.

After being subjected to the first cold roll/recovery temperature treatment, the coils were subjected to a second cold roll reduction by being passed successively through a pair of reduction rolls until each of the coils was reduced 25% in thickness (to 0.039 to 0.044 inches).

After the second cold roll reduction, the coils were placed back in the furnace and subjected to a second recovery heating by raising the temperature of the furnace to 500° F. over a 3.5 hour period, and holding at that temperature for 1.5 hours. The coils were annealed at a recrystallization temperature by raising the temperature of the furnace to 800° F. over a 6 hour period and held at this temperature for 3 hours. The coils were allowed to cool in the furnace to 300° F. over a 14 hour period and then removed from the furnace and allowed to cool to room temperature over the next 48 hours.

The recrystallized coils were then work hardened by passing the coils successively in a commercial rolling mill until each coil was reduced about 65 to 67% in thickness to 0.0135±0.0003 inches.

The work hardened coils were then fabricated into two-piece aluminum beverage cans on a commercial draw and wall iron manufacturing line, about 5000 cans being fabricated from each coil. No galling was encountered. Earing ranged from 2.0 to 2.6%.

The cans were also evaluated for buckle strength, i.e., ability of the can to withstand high internal pressure without bottom inversion.

Buckle strength is determined by applying pressure within a drawn and wall-ironed can and then gradually increasing the pressure until the bottom end of the can deforms and bulges out, i.e., it buckles. The pressure at which the bottom buckles is then designated as the buckle strength. To be acceptable as can body stock, a trimmed can formed from the alloy sheet must exhibit a buckle strength of at least 90 pounds per square inch (psi), preferably between 95 and 100 psi.

The average buckle strength for cans fabricated from alloys A, B and C in the above manner are recorded in the Table XV below:

TABLE XV

| Alloy | Buckle Strength (psi) |
|---|---|
| A | 98 |
| B | 91 |
| C | 100 |

What is claimed is:

1. A process for fabricating aluminum alloy strip stock suitable for the manufacture of drawn and wall-ironed articles comprising continuously casting an aluminum alloy in strip form having a thickness up to one inch, homogenizing the strip at a temperature of about 950° to about 1150° F. for up to 50 hours, cold rolling the homogenized strip by at least 25% reduction in thickness, heating the cold rolled strip to a recovery temperature of between about 350° and about 550° F., cold rolling the strip to a second reduction in thickness of at least 10%, heating the cold rolled strip to a recrystallization temperature of between about 600° and about 900° F. and then, cold rolling the recrystallized strip to a final gauge having a total reduction in thickness of at least about 50%.

2. The process of claim 1 wherein the continuous cast aluminum strip has a thickness of between about 0.25 and about 0.50 inch.

3. The process of claim 1 wherein the strip is homogenized at a temperature between about 1000° and about 1100° F. for about 10 to about 25 hours.

4. The process of claim 1 wherein the first cold roll reduction effects a reduction in thickness of about 50 to about 85%.

5. The process of claim 1 wherein the strip is heated at a recovery temperature between about 425° and about 475° F. for about 2 to about 4 hours.

6. The process of claim 1 wherein the strip is heated at a recovery temperature of about 425° to about 475° F. for about 2 to 4 hours.

7. The process of claim 1 wherein the cold rolled strip is heated to a recrystallization temperature between about 700° and about 850° F. for about 2 to about 3 hours.

8. The process of claim 1 wherein the second cold roll reduction effects a reduction in thickness of about 10 to 50%.

9. The process of claim 1 wherein the strip is heated to a second recovery temperature after the second cold roll and prior to heating the strip to the recrystallization temperature, the second recovery temperature being in the range of about 450° to about 550° F., the heating being effected for about 0.5 to about 3 hours.

10. The process of claim 1 wherein the recrystallized strip is cold rolled to a final gauge having a total reduction in thickness of about 60 to about 90%.

11. The process of claim 1 wherein the aluminum alloy is Aluminum Association Specification 3004 aluminum alloy.

* * * * *